US010094567B2

(12) United States Patent
Igarashi et al.

(10) Patent No.: US 10,094,567 B2
(45) Date of Patent: Oct. 9, 2018

(54) DUAL-FUEL INJECTOR WITH A DOUBLE PIPE SLEEVE GASEUS FUEL FLOW PATH

(71) Applicant: Mitsubishi Hitachi Power Systems, Ltd., Yokohama-shi, Kanagawa (JP)

(72) Inventors: Shota Igarashi, Yokohama (JP); Hirokazu Takahashi, Yokohama (JP)

(73) Assignee: Mitsubishi Hitachi Power Systems, Ltd., Yokohama-shi (JP)

( * ) Notice: Subject to any disclaimer, the term of this patent is extended or adjusted under 35 U.S.C. 154(b) by 734 days.

(21) Appl. No.: 14/461,532

(22) Filed: Aug. 18, 2014

(65) Prior Publication Data

US 2015/0082770 A1 Mar. 26, 2015

(30) Foreign Application Priority Data

Sep. 20, 2013 (JP) ..... 2013-195007

(51) Int. Cl.
*F23R 3/30* (2006.01)
*F23R 3/32* (2006.01)
(Continued)

(52) U.S. Cl.
CPC ..... *F23R 3/286* (2013.01); *F23R 3/34* (2013.01); *F23R 3/36* (2013.01); *F23D 2211/00* (2013.01);
(Continued)

(58) Field of Classification Search
CPC .. F23R 3/283; F23R 3/286; F23R 3/30; F23R 3/32; F23R 3/36
See application file for complete search history.

(56) References Cited

U.S. PATENT DOCUMENTS 3,662,547 A * 5/1972 Paine ..... F02K 9/52 239/424
3,768,251 A * 10/1973 Camboulives ..... F23R 3/283 60/739
(Continued)

FOREIGN PATENT DOCUMENTS

EP 2 236 933 A1 10/2010
JP 2003-148734 A 5/2003
(Continued)

OTHER PUBLICATIONS

European Search Report dated Jan. 21, 2015 (Five (5) Pages).
(Continued)

*Primary Examiner* — Lorne Meade
*Assistant Examiner* — Eric Linderman
(74) *Attorney, Agent, or Firm* — Crowell & Moring LLP

(57) ABSTRACT

A dual-fuel burning gas turbine combustor having a diffusive combustion burner to burn a liquid fuel and a gaseous fuel placed at the axis of the gas turbine combustor and a plurality of pre-mixing combustion burners to burn a liquid fuel and a gaseous fuel placed on an outer circumferential side of the diffusive combustion burner, each pre-mixing combustion burner having a liquid fuel nozzle, a plurality of gaseous fuel spray holes, a plurality of air holes, and a pre-mixing chamber to mix gaseous fuel and air, wherein each pre-mixing combustion burner has a double pipe sleeve at a connected portion between end cover and the pre-mixing combustion burner, and the double pipe sleeve has an inner sleeve having a gaseous fuel flow path, an outer sleeve positioned on an outer circumferential side of the inner sleeve, and a circular spacing formed between the inner sleeve and the outer sleeve.

5 Claims, 5 Drawing Sheets

(51) Int. Cl.
*F23R 3/34* (2006.01)
*F23R 3/36* (2006.01)
*F23R 3/28* (2006.01)

(52) U.S. Cl.
CPC .... *F23D 2900/00008* (2013.01); *F23R 3/283* (2013.01); *F23R 3/30* (2013.01); *F23R 3/32* (2013.01); *F23R 2900/00002* (2013.01)

(56) References Cited

U.S. PATENT DOCUMENTS 3,937,011 A * 2/1976 Caruel ..... F23D 11/107 239/404
4,258,544 A * 3/1981 Gebhart ..... F02C 7/222 60/742
5,361,578 A * 11/1994 Donlan ..... F02C 3/30 60/39.55
5,488,829 A * 2/1996 Southall ..... F23R 3/12 60/725
5,899,074 A * 5/1999 Komatsu ..... F23D 23/00 60/39.21
6,272,840 B1 * 8/2001 Crocker ..... F02C 7/22 239/404
6,415,594 B1 * 7/2002 Durbin ..... F23R 3/286 60/748
6,543,235 B1 * 4/2003 Crocker ..... F23C 9/006 60/742
7,513,116 B2 * 4/2009 Hebert ..... F23D 11/24 60/740
8,127,549 B2 * 3/2012 Miura ..... F23R 3/10 60/737
8,555,648 B2 * 10/2013 Khosla ..... F23D 11/16 60/742
9,027,349 B2 * 5/2015 Miura ..... F23R 3/286 60/737
9,074,772 B2 * 7/2015 Miura ..... F23R 3/10
2001/0004827 A1 * 6/2001 Vandervort ..... F23R 3/14 60/39.55
2003/0221429 A1 * 12/2003 Laing ..... F23D 11/36 60/740
2004/0011054 A1 * 1/2004 Inoue ..... F23R 3/10 60/776
2004/0255589 A1 * 12/2004 Yoshida ..... F23R 3/343 60/746
2004/0265136 A1 * 12/2004 Martling ..... F23D 17/002 417/53
2006/0127827 A1 * 6/2006 Yoshida ..... F23C 7/004 431/8
2006/0191268 A1 * 8/2006 Widener ..... F23D 14/78 60/772
2007/0003897 A1 * 1/2007 Koizumi ..... F23R 3/28 431/354
2008/0245074 A1 * 10/2008 Oda ..... F02C 7/228 60/737
2008/0289340 A1 * 11/2008 Oda ..... F23R 3/28 60/737
2008/0302105 A1 * 12/2008 Oda ..... F23R 3/28 60/737
2009/0044538 A1 * 2/2009 Pelletier ..... F23R 3/14 60/740
2009/0165435 A1 * 7/2009 Koranek ..... F23D 17/002 60/39.463
2009/0173057 A1 * 7/2009 Yoshida ..... F01D 15/10 60/39.281
2010/0170248 A1 7/2010 Yoshida et al.
2010/0192586 A1 8/2010 Terada et al.
2011/0094239 A1 * 4/2011 Koizumi ..... F23R 3/346 60/776
2011/0107764 A1 * 5/2011 Bailey ..... F01D 25/28 60/737
2011/0197594 A1 * 8/2011 Khosla ..... F23D 11/38 60/776
2011/0314826 A1 * 12/2011 Jordan ..... F23R 3/283 60/740
2012/0031102 A1 * 2/2012 Uhm ..... F02C 7/222 60/776
2012/0079828 A1 * 4/2012 Saitou ..... F01D 9/023 60/740
2012/0186266 A1 * 7/2012 Khan ..... F02C 3/20 60/780
2012/0291444 A1 * 11/2012 Oskam ..... F23R 3/36 60/772
2012/0291446 A1 * 11/2012 Hirata ..... F23D 11/402 60/772
2013/0029277 A1 * 1/2013 Koizumi ..... F23R 3/10 431/354
2013/0091824 A1 * 4/2013 Murakami ..... F01D 25/12 60/39.094
2013/0152593 A1 * 6/2013 Oskam ..... F23R 3/28 60/772
2013/0192245 A1 * 8/2013 Miura ..... F23R 3/04 60/776
2013/0291546 A1 * 11/2013 Cortes ..... F23D 11/24 60/735
2014/0060063 A1 * 3/2014 Boardman ..... F23R 3/286 60/772
2014/0069079 A1 * 3/2014 Koizumi ..... F23R 3/12 60/39.463
2014/0144144 A1 * 5/2014 Hirata ..... F23R 3/283 60/738
2014/0245738 A1 * 9/2014 Crothers ..... F02C 7/228 60/725
2014/0245740 A1 * 9/2014 Wiebe ..... F02C 7/222 60/740
2015/0059353 A1 * 3/2015 Asai ..... F02C 3/22 60/778
2015/0082797 A1 * 3/2015 Matsuyama ..... F23R 3/14 60/746
2015/0128601 A1 * 5/2015 Matsubara ..... F23R 3/286 60/747
2016/0025346 A1 * 1/2016 Hirata ..... F23R 3/286 60/738
2016/0146459 A1 * 5/2016 Gibson ..... F23D 17/002 60/737
2016/0305668 A1 * 10/2016 Romig ..... F23R 3/343
2016/0377294 A1 * 12/2016 Wadayama ..... F23R 3/343 60/737

FOREIGN PATENT DOCUMENTS

JP 2006-105488 A 4/2006
JP 2007-327338 A 12/2007
JP 2013-177988 A 9/2013
WO WO 2009/028475 A1 3/2009

OTHER PUBLICATIONS

Japanese-language Office Action issued in counterpart Japanese Application No. 2013-195007 dated Jun. 13, 2017 with English translation (5 pages).

* cited by examiner

DUAL-FUEL INJECTOR WITH A DOUBLE PIPE SLEEVE GASEUS FUEL FLOW PATH

CLAIM OF PRIORITY

The present application claims priority from Japanese patent application serial No. 2013-195007, filed on Sep. 20, 2013, the content of which is hereby incorporated by reference into this application.

BACKGROUND OF THE INVENTION

Technical Field

The present invention relates to a gas turbine combustor and, more particularly, to a dual-fuel burning gas turbine combustor which is a multi-burner type gas turbine combustor including a plurality of burners and corresponds to both a liquid fuel and a gaseous fuel.

Background Art

Due to a recent critical demand for electric power in the power generation business, there is an increasing need for the use of various types of fuels including liquid fuels, which can be relatively easily supplied, so gas turbine power generation facilities that use a liquid fuel combustor are demanded.

An available gas turbine combustor uses a pre-evaporation/pre-mixing combustion method, in which a liquid fuel is mixed with air before the fuel is burned from the viewpoint of environment protection.

Technologies related to a dual-fuel burning gas turbine combustor that corresponds to both a liquid fuel and a gaseous fuel are disclosed in Japanese Laid-open Patent Publication Nos. 2007-327338 and 2003-148734.

The technology disclosed in Japanese Laid-open Patent Publication No. 2003-148734 relates to a gas turbine combustor in which a diffusive combustion burner is placed at the center and a plurality of pre-mixing combustion burners, each of which has a cylindrical mixing chamber to mix a fuel with combustion air, are provided around the outer circumference of the diffusive combustion burner.

The diffusive combustion burner disposed in the gas turbine combustor disclosed in Japanese Laid-open Patent Publication No. 2003-148734 has air holes to swivel combustion air. Combustion gas at a high temperature is spread toward the outer circumferential to use it as a firing source of the pre-mixing combustion burner, making its combustion more stable.

The pre-mixing combustion burner disposed in the gas turbine combustor has a liquid fuel nozzle substantially at the center of the axis and the mixing chamber is disposed downstream of the liquid fuel nozzle.

CITATION LIST

Patent Literature

{Patent Literature 1} Japanese Laid-open Patent Publication No. 2007-327338

{Patent Literature 2} Japanese Laid-open Patent Publication No. 2003-148734

SUMMARY OF INVENTION

Technical Problem

If a liquid fuel nozzle is placed at the center of a multi-burner in a dual-fuel burning gas turbine combustor which is a multi-burner type gas turbine combustor and supports both a liquid fuel and a gaseous fuel as, for example, described in Japanese Laid-open Patent Publication No. 2003-148734, a gaseous fuel nozzle needs to be placed outside the center of the axis of the multi-burner.

To prevent a gaseous fuel from leaking to the outside, a method in which an O-ring or the like is used for a tight seal can be considered. However, since combustion air has been pressurized with a compressor, the air is at a high temperature, whereas a gaseous fuel is supplied at room temperature. Accordingly, a difference in temperature occurs between the combustion air and the gaseous fuel, so the O-ring cannot follow thermal deformation caused by the difference in temperature at the time of gaseous fuel supply. As a result, the gaseous fuel may leak to the outside.

If a single-tube sleeve is used instead of the O-ring, a method is available in which the sleeve is welded to an end cover and the pre-mixing combustion burner to prevent the gaseous fuel from leaking to the outside; however, when the sleeve is welded, the single-tube sleeve may be thermally contracted due to a rapid temperature change in the sleeve and excessive thermal stress may be exerted on the welded portion.

An object of the present invention is to provide a dual-fuel burning gas turbine combustor that suppresses thermal contraction caused due to a difference in temperature when a gaseous fuel is supplied and reduces stress exerted on a welded portion by which a sleeve is attached, while having high reliability and corresponding both a liquid fuel and a gaseous fuel.

Solution to Problem

The dual-fuel burning gas turbine combustor in the present invention is a dual-fuel burning gas turbine combustor corresponds to both a liquid fuel and a gaseous fuel, in which a diffusive combustion burner that burns a liquid fuel and a gaseous fuel is placed at the center of the axis of the gas turbine combustor and a plurality of pre-mixing combustion burners are placed on the outer circumferential side of the diffusive combustion burner, each pre-mixing combustion burner having a liquid fuel nozzle through which the liquid fuel is supplied, a plurality of gaseous fuel spray holes through which the gaseous fuel is supplied, a plurality of air holes through which a combustion air is supplied, and the fuel spray holes and the air holes are being placed on an outer circumferential side of the liquid fuel nozzle, and a pre-mixing chamber in which the gaseous fuel and combustion air are mixed together, characterized in that: each pre-mixing combustion burner has a double pipe sleeve at a connected portion between a flow path through which the gaseous fuel is led, the flow path being provided on an end cover disposed on the upstream side of the gas turbine combustor, and a gaseous fuel flow path through which the gaseous fuel is led to the pre-mixing combustion chamber, the gaseous fuel flow path being provided in the pre-mixing combustion burner; and the double pipe sleeve has an inner sleeve having a gaseous fuel flow path through which the gaseous fuel flows down, an outer sleeve positioned on the outer circumferential side of the inner sleeve, and a circular spacing formed between the inner sleeve and the outer sleeve.

Advantageous Effects of Invention

According to the present invention, there can be achieved a dual-fuel burning gas turbine combustor that suppresses thermal contraction caused due to a difference in temperature when a gaseous fuel is supplied and reduces stress exerted on a welded portion by which a sleeve is attached, while having high reliability and corresponding both a liquid fuel and a gaseous fuel.

DESCRIPTION OF EMBODIMENTS

A dual-fuel burning gas turbine combustor, in an embodiment of the present invention, that can use both a liquid fuel and a gaseous fuel will be described below with reference to the drawings.

Embodiment 1

A dual-fuel burning gas turbine combustor, in a first embodiment of the present invention, that can use both a liquid fuel and a gaseous fuel will be described below with reference to FIGS. 1 to 4.

Figure 1:
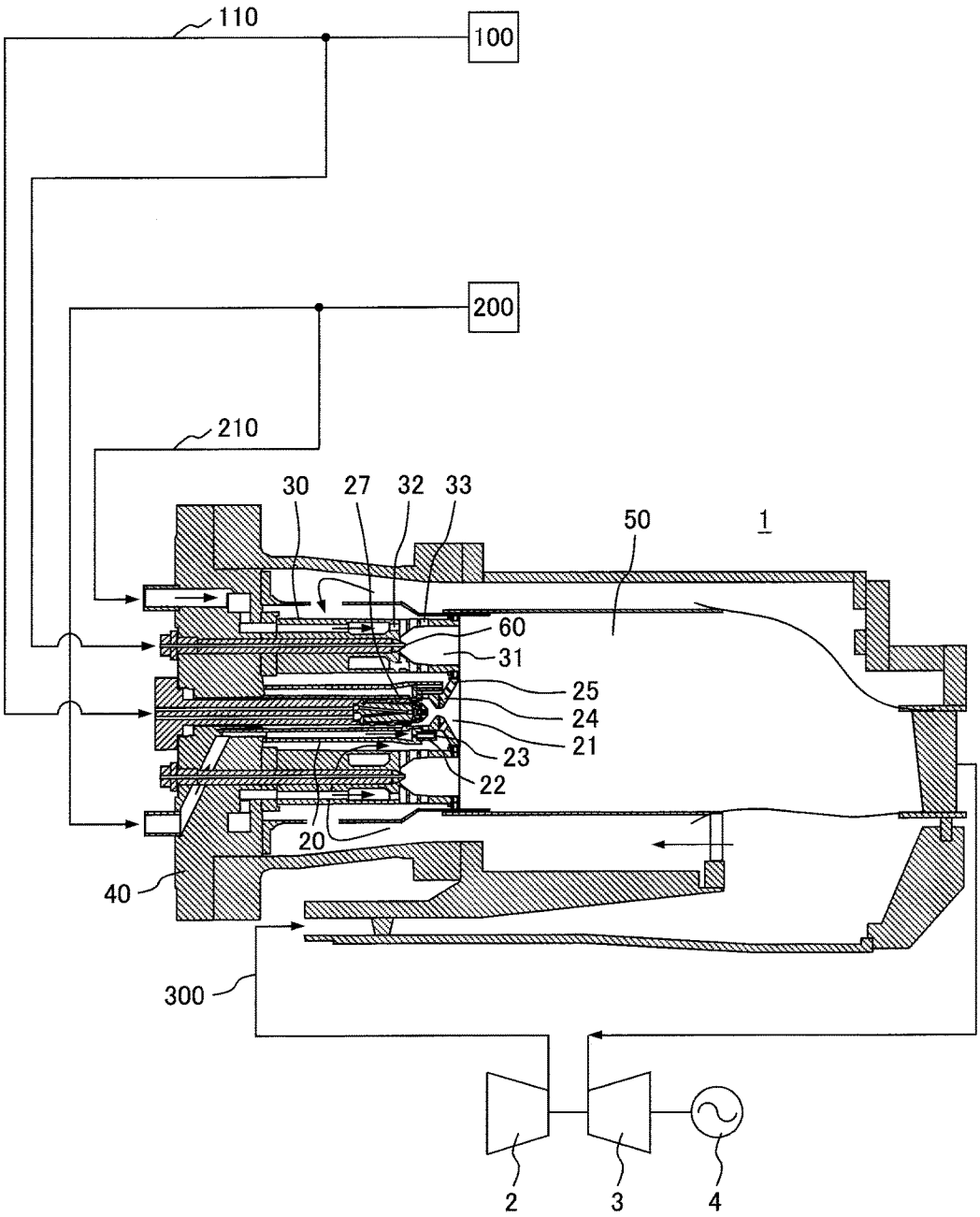
FIG. 1 is a schematic cross sectional view of a dual-fuel burning gas turbine combustor in a first embodiment of the present invention in the axial direction, illustrating a situation at the time of liquid fuel supply.
Figure 2A:
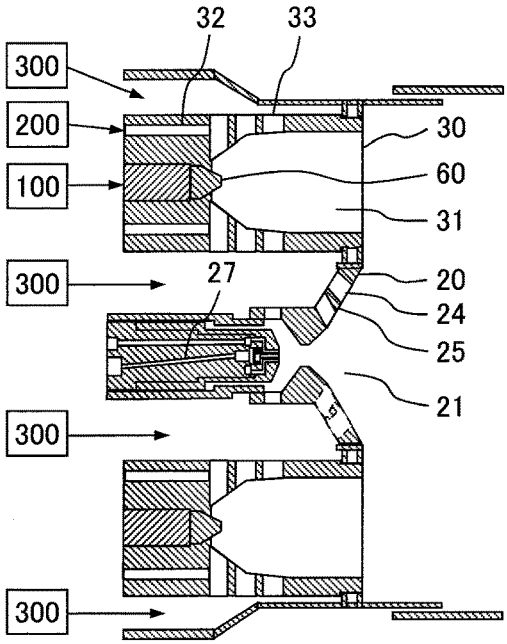
FIG. 2A is a partial cross sectional view of the dual-fuel burning gas turbine combustor, illustrated in FIG. 1, in the first embodiment in the axial direction, illustrating a situation at the time of gaseous fuel supply.
Figure 2B:
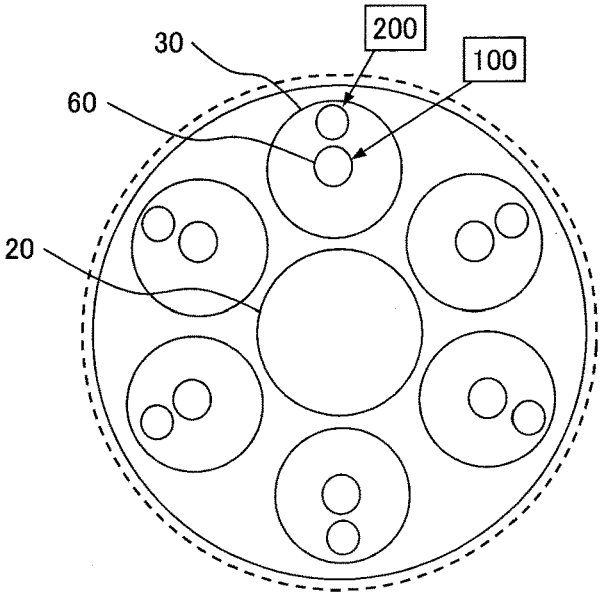
FIG. 2B is a plan view of the dual-fuel burning gas turbine combustor, illustrated in FIG. 2A, in the first embodiment in the axial direction, illustrating a structure at a partial cross section when viewed from a combustion chamber.

In FIGS. 1, 2A, and 2B, a dual-fuel burning gas turbine combustor 1, in the first embodiment of the present invention, that can use both a liquid fuel and a gaseous fuel includes a diffusive combustion burner 20 that sprays a liquid fuel 100 and a gaseous fuel 200 toward a combustion chamber 50 to burn them, the diffusive combustion burner 20 being disposed at the center of the axial direction of the dual-fuel burning gas turbine combustor 1. A plurality of pre-mixing combustion burners 30 are placed on the outer circumferential side of the diffusive combustion burner 20; for example, six pre-mixing combustion burners 30 that spray the liquid fuel 100 and gaseous fuel 200 toward the combustion chamber 50 to burn them are placed on the outer circumferential side of the diffusive combustion burner 20 so as to be mutually spaced.

The combustion chamber 50, which is substantially cylindrical, is formed in the interior of the body of the gas turbine combustor 1. The liquid fuel 100 and gaseous fuel 200 are supplied from the diffusive combustion burner 20 and pre-mixing combustion burner 30 to the combustion chamber 50, where the liquid fuel 100 and gaseous fuel 200 are burned.

A combustion gas generated as a result of combustion in the combustion chamber 50 of the gas turbine combustor 1 is supplied from the gas turbine combustor 1 to a turbine 3 and drives the turbine 3 to rotate a power generator 4 connected to the turbine 3, generating electric power.

When the turbine 3 is driven, a compressor 2 connected to the turbine 3 is also rotated to supply combustion air 300 to be used in the gas turbine combustor 1 is supplied from the compressor 2 to the gas turbine combustor 1.

The diffusive combustion burner 20 disposed at the center of the axial direction of the gas turbine combustor 1 includes a liquid fuel nozzle 27 through which the liquid fuel 100 is supplied, a gaseous fuel nozzle 22 through which the gaseous fuel 200 is supplied, the gaseous fuel nozzle 22 being placed on the outer circumferential side of the liquid fuel nozzle 27, and a cone plate 25 that has many gaseous fuel spray holes 23 through which the gaseous fuel 200 supplied from the gaseous fuel nozzle 22 is supplied to a mixing chamber 21, and many air holes 24 through which the combustion air 300 is supplied to the mixing chamber 21.

The mixing chamber 21 formed by the cone plate 25 is formed at the top of the diffusive combustion burner 20 so as to face the combustion chamber 50 of the gas turbine combustor 1.

Specifically, the substantially conical mixing chamber 21 partitioned by the cone plate 25 is formed at the top of the diffusive combustion burner 20 to mix the gaseous fuel 200 sprayed from the gaseous fuel nozzle 22 and supplied from the gaseous fuel spray holes 23 in the cone plate 25 with the combustion air 300 supplied from the air holes 24 in the cone plate 25.

After the gaseous fuel 200 supplied from the gaseous fuel spray holes 23 in the cone plate 25 to the mixing chamber 21 has been mixed with the combustion air 300 supplied from the air holes 24 in the cone plate 25 in the mixing chamber 21, the gaseous fuel 200 flows into the combustion chamber 50 of the gas turbine combustor 1, the combustion chamber 50 being disposed downstream of the mixing chamber 21, and is then burned.

Each of the six pre-mixing combustion burners 30 placed on the outer circumferential side of the diffusive combustion burner 20 of the gas turbine combustor 1 has a liquid fuel nozzle 60 from which the liquid fuel 100 is sprayed. A wall surface on which a substantially cylindrical pre-mixing chamber 31 is formed, the chamber 31 being disposed on a member of the pre-mixing combustion burner 30 at the top of the pre-mixing combustion burner 30 disposed downstream of the liquid fuel nozzle 60, includes a plurality of gaseous fuel spray holes 32 through which the gaseous fuel 200 is supplied to the pre-mixing chamber 31 and a plurality of air holes 33 through which the combustion air 300 is supplied to the pre-mixing chamber 31. In the pre-mixing chamber 31, the gaseous fuel 200 supplied from the gaseous fuel spray holes 32 to the pre-mixing chamber 31 is mixed with the combustion air 300 supplied from the air holes 33 to the pre-mixing chamber 31, after which the resulting mixed gas flows into the combustion chamber 50 on the downstream side and is then burned.

In this dual-fuel burning gas turbine combustor 1 that supplies the liquid fuel 100 and gaseous fuel 200 as fuels, a plurality of liquid fuel supply paths 110 are included as fuel supply paths, each of which supplies the liquid fuel 100 from a fuel tank (not illustrated) to the liquid fuel nozzle 27 of the diffusive combustion burner 20 and to the liquid fuel nozzles 60 of the six pre-mixing combustion burners 30 disposed on the outer circumferential side of the diffusive combustion burner 20.

The dual-fuel burning gas turbine combustor 1 also has a plurality of gaseous fuel supply paths 210, each of which supplies the gaseous fuel 200 from a gaseous fuel tank (not illustrated) through the gaseous fuel spray holes 32 of the pre-mixing combustion burner 30 to the pre-mixing chamber 31. Furthermore, the combustion air 300 is supplied through the air holes 33 of the pre-mixing combustion burner 30 to the pre-mixing chamber 31 so that the gaseous fuel 200 and combustion air 300 are mixed together in the pre-mixing chamber 31, after which the resulting mixed gas flows into the combustion chamber 50 and is then burned.

The liquid fuel supply paths 110 and gaseous fuel supply paths 210 are connected to an end cover 40 disposed on the upstream side of the dual-fuel burning gas turbine combustor 1. The gaseous fuel 200 that has been supplied through the gaseous fuel supply paths 210 is supplied to the diffusive combustion burner 20 and pre-mixing combustion burners 30, which are disposed in the dual-fuel burning gas turbine combustor 1, and is then burned in the combustion chamber 50 on the downstream side.

The liquid fuel 100 supplied through the liquid fuel supply paths 110 is supplied to the liquid fuel nozzle 27 of the diffusive combustion burner 20 disposed in the dual-fuel burning gas turbine combustor 1 and to the liquid fuel nozzles 60 disposed in the pre-mixing combustion burner 30, and is then burned in the combustion chamber 50 disposed on the downstream side.

The diffusive combustion burner 20 disposed in the dual-fuel burning gas turbine combustor 1 in this embodiment includes the gaseous fuel nozzle 22 through which the gaseous fuel 200 is supplied to the substantially conical mixing chamber 21 formed in the diffusive combustion burner 20 in the gas turbine combustor 1 and also has the gaseous fuel spray holes 23 formed in the cone plate 25 so that the gaseous fuel 200 sprayed from the gaseous fuel nozzle 22 is led to the interior of the substantially conical mixing chamber 21.

The gaseous fuel nozzle 22 is placed at a position close to the upstream side of the air holes 24, which are formed so that the combustion air 300 is led to the cone plate 25 of the diffusive combustion burner 20.

The gaseous fuel 200 is supplied to the combustion chamber 50 while being mixed with the combustion air 300 in the air holes 24 and mixing chamber 21.

In the substantially conical pre-mixing chamber 31 formed in the pre-mixing combustion burner 30 disposed in the gas turbine combustor 1, the gaseous fuel spray holes 32, through which the gaseous fuel 200 is supplied, and the air holes 33, through which the combustion air 300 is supplied, are formed on the wall surface of the pre-mixing chamber 31, and the liquid fuel nozzle 60, through which the liquid fuel 100 is supplied, is disposed at the center of the axis of the pre-mixing combustion burner 30.

The gaseous fuel 200 supplied from the gaseous fuel spray holes 32 is supplied to the combustion chamber 50 while being mixed with the combustion air 300 in the air holes 33 and pre-mixing chamber 31.

As in the case in which the liquid fuel 100 is supplied, the mixed gas of the gaseous fuel 200 and combustion air 300 is burned in the combustion chamber 50 and the resulting combustion gas at a high temperature drives the turbine 3.

The end cover 40, to which both the liquid fuel 100 and the gaseous fuel 200 are supplied, is disposed on the upstream side of the dual-fuel burning gas turbine combustor 1 in this embodiment. The end cover 40 is used as a base to which the diffusive combustion burner 20 and the six pre-mixing combustion burners 30 are attached on the downstream side of the dual-fuel burning gas turbine combustor 1.

The layout of the diffusive combustion burner 20 and pre-mixing combustion burners 30 in the dual-fuel burning gas turbine combustor 1 in this embodiment will be described with reference to FIGS. 2A and 2B.

In the dual-fuel burning gas turbine combustor 1 in this embodiment, the six pre-mixing combustion burners 30 are secured with bolts around the single diffusive combustion burner 20.

As illustrated in FIGS. 2A and 2B, the liquid fuel nozzle 60 is disposed at the center of the axis of each of the six pre-mixing combustion burners 30. Therefore, each gaseous fuel spray hole 32, through which the gaseous fuel 200 is supplied to the pre-mixing chamber 31 of the pre-mixing combustion burner 30, needs to be placed at a position apart from the liquid fuel nozzle 60.

Next, the flow paths of the liquid fuel 100 and gaseous fuel 200 supplied to the pre-mixing combustion burner 30 in the dual-fuel burning gas turbine combustor 1 in this embodiment will be described with reference to FIG. 3.

Figure 3:
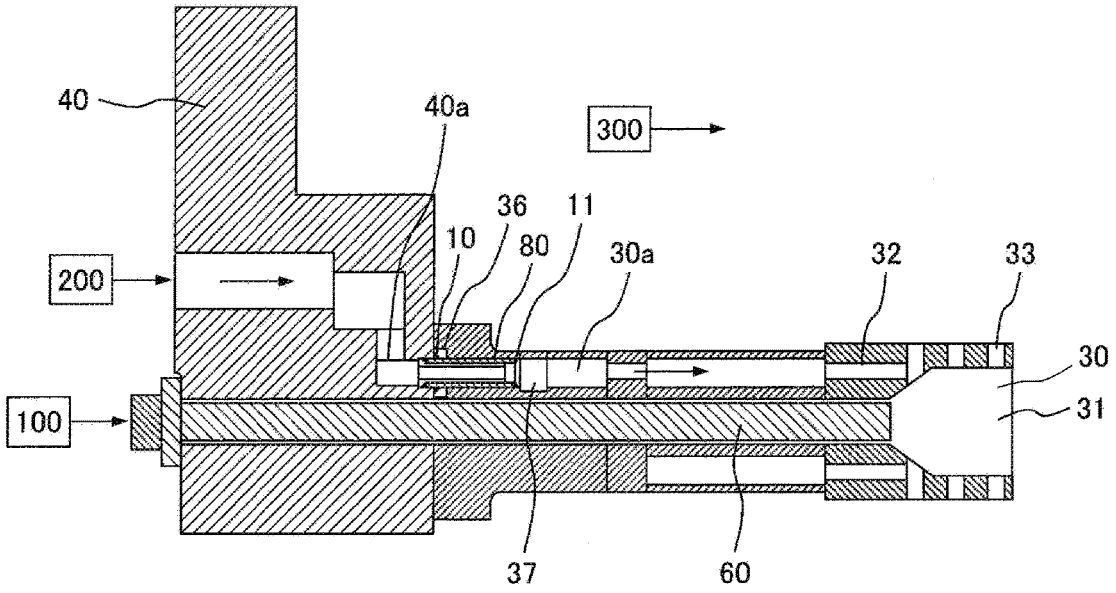
FIG. 3 is a partial cross sectional view of a pre-mixing combustion burner in the dual-fuel burning gas turbine combustor, illustrated in FIGS. 1 and 2, in the first embodiment when a liquid fuel and a gaseous fuel are supplied.

As illustrated in FIG. 3, the gaseous fuel 200 passes through the interior of the end cover 40 and flows into the gaseous fuel spray holes 32 formed in the pre-mixing combustion burner 30. After having passed through the gaseous fuel spray holes 32, the gaseous fuel 200 is supplied to the pre-mixing chamber 31 while being mixed with the combustion air 300 in the air holes 33 in the pre-mixing combustion burner 30.

As illustrated in FIG. 3, the liquid fuel 100 is supplied from the liquid fuel nozzle 60 disposed at the center of the axis of the pre-mixing combustion burner 30 to the pre-mixing chamber 31.

That is, a gaseous fuel flow path, through which the gaseous fuel 200 passes, and a liquid fuel flow path, through which the liquid fuel 100 passes, are present in the end cover 40 and pre-mixing combustion burner 30.

A double pipe sleeve 80, which is formed with an inner sleeve 81 and an outer sleeve 82, is attached to a connected portion between a gaseous fuel flow path 40*a*, through which the gaseous fuel 200 passes, the gaseous fuel flow path 40*a* being disposed in the end cover 40, and a gaseous fuel flow path 30*a*, through which the gaseous fuel 200 passes, the gaseous fuel flow path 30*a* being disposed in the pre-mixing combustion burner 30 attached to the end cover 40. To prevent the gaseous fuel 200 flowing down through the double pipe sleeve 80 from leaking from the double pipe sleeve 80 to the combustion air 300, which is on the outer circumferential side of the pre-mixing combustion burner 30, the double pipe sleeve 80 is secured with an all-around fillet welded portion 10 and an all-around single-bevel butt fillet welded portion 11. By the all-around fillet welded portion 10, one end of the outer sleeve 82 of the double pipe sleeve 80 is welded to a side of the end cover 40. By the all-around single-bevel butt fillet welded portion 11, the other end of the outer sleeve 82 is welded to the inner wall surface of the gaseous fuel flow path 30*a* of the pre-mixing combustion burner 30.

To weld the double pipe sleeve 80 to the side of the end cover 40, a notch 36 is formed at an end of the pre-mixing combustion burner 30, the end facing the side of the end cover 40. The notch 36 is shaped so that a groove is partially formed.

The structure of the double pipe sleeve 80, which is disposed in the end cover 40 and pre-mixing combustion burner 30 to supply the gaseous fuel 200 at a low temperature to the pre-mixing combustion burner 30, will be described with reference to FIG. 4.

Figure 4:
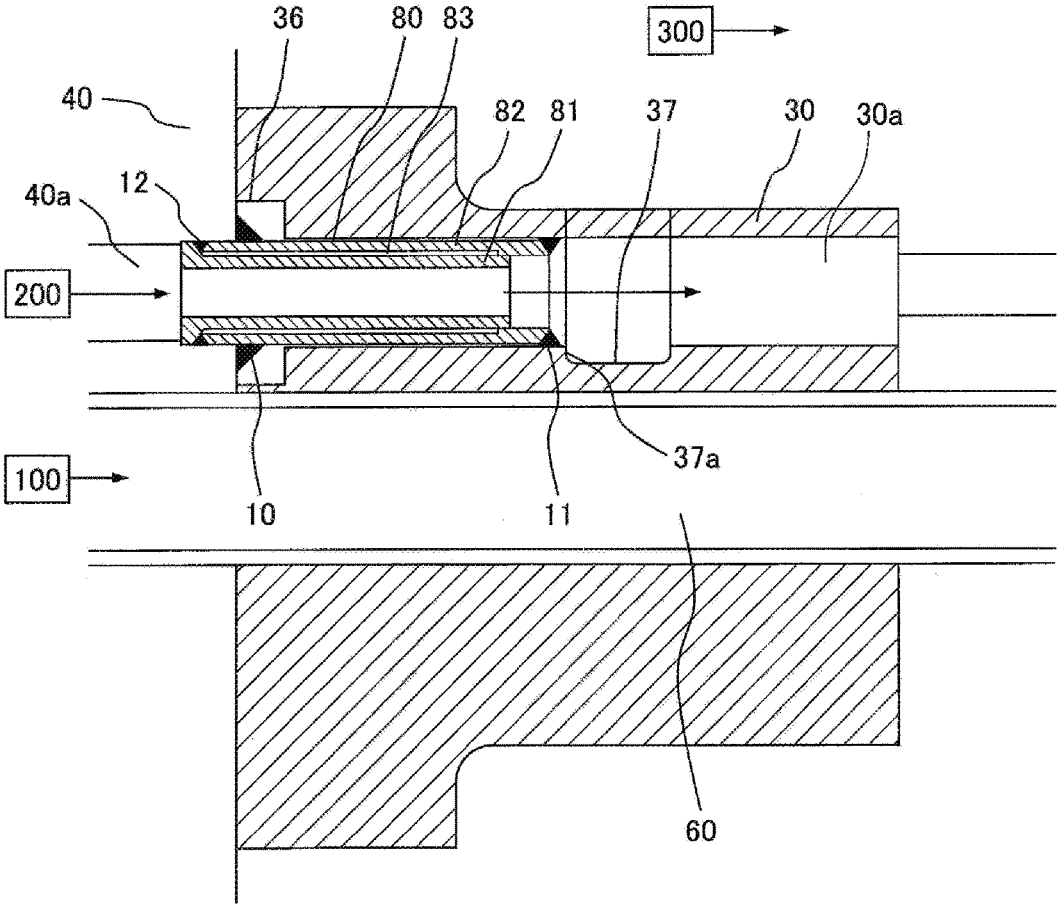
FIG. 4 is a partial cross sectional view of a double pipe sleeve provided in the pre-mixing combustion burner in the dual-fuel burning gas turbine combustor, illustrated in FIG. 3, in the first embodiment of the present invention when a gaseous fuel is supplied.

As illustrated in FIG. 4, the double pipe sleeve 80, which is disposed in the end cover 40 and pre-mixing combustion burner 30 to prevent the gaseous fuel 200 from leaking to the combustion air 300, is formed with a combination of two types of sleeves, a cylindrical inner sleeve 81 and a cylindrical outer sleeve 82. The outer sleeve 82 is disposed on the outer circumferential side of the inner sleeve 81 so as to be concentric with the inner sleeve 81.

The inner sleeve 81 of the double pipe sleeve 80 is a sleeve with which the gaseous fuel 200 that flows down from the gaseous fuel flow path 40*a* formed in the end cover 40 to the gaseous fuel flow path 30*a* formed in the pre-mixing combustion burner 30 directly comes into contact. When the gaseous fuel 200 at a low temperature is supplied through the inner sleeve 81, the inner sleeve 81 undergoes a rapid temperature change, causing significant thermal contraction.

Part of the inside of the inner sleeve 81 has a role of an orifice. It has a function of suppressing a change in the flow rate of the gaseous fuel 200 flowing down through the gaseous fuel flow path 30*a* of the pre-mixing combustion burner 30.

The outer sleeve 82 of the double pipe sleeve 80 does not directly come into contact with the gaseous fuel 200, but is thermally contracted by a heat transmitted from the inner sleeve 81.

The outer sleeve 82 is mainly secured to a side of the end cover 40 and the inner wall surface of the gaseous fuel flow path 30*a* of the pre-mixing combustion burner 30 with the all-around fillet welded portion 10 and the all-around single-bevel butt fillet welded portion 11. Furthermore, the upstream ends of the inner sleeve 81 and outer sleeve 82 are mutually welded through a welded portion 12 so as to be secured, forming the double pipe sleeve 80.

As illustrated in FIG. 4, the upstream ends of the inner sleeve 81 and outer sleeve 82, which constitute the double pipe sleeve 80, are mutually welded through the welded portion 12, and a circular spacing 83 is formed between the inner sleeve 81 and the outer sleeve 82 except their upstream ends and downstream ends.

The downstream ends of the inner sleeve 81 and outer sleeve 82, which constitute the double pipe sleeve 80, are structured so that the outer circumferential side of the inner sleeve 81 fits to the inner circumferential side of the outer sleeve 82.

Furthermore, as illustrated in FIG. 4, the upstream side of the outer sleeve 82 of the double pipe sleeve 80 is secured to a side of the end cover 40 with the all-around fillet welded portion 10, the entire periphery of which is fillet welded; the downstream side of the outer sleeve 82 is secured to the inner wall of the gaseous fuel flow path 30*a* of the pre-mixing combustion burner 30 with the all-around single-bevel butt fillet welded portion 11, the entire periphery of which is welded in single-bevel butt fillet welding.

As illustrated in FIGS. 3 and 4, the double pipe sleeve 80 is secured to the end cover 40 and pre-mixing combustion burner 30 by providing the all-around fillet welded portion 10 and all-around single-bevel butt fillet welded portion 11 to the outer sleeve 82 of the double pipe sleeve 80, so that even in a case in which the gaseous fuel 200 at a low temperature is supplied to the inner sleeve 81 of the double pipe sleeve 80, thermal contraction caused in the outer sleeve 82 of the double pipe sleeve 80 is mitigated, prolonging the operating life of the double pipe sleeve 80 and preventing the gaseous fuel 200 flowing down through the double pipe sleeve 80 from leaking to the combustion air 300, which is on the circumferential side of the pre-mixing combustion burner 30.

Furthermore, the downstream ends of the inner sleeve 81 and outer sleeve 82, which constitute the double pipe sleeve 80 disposed in the end cover 40 and pre-mixing combustion burner 30, are structured so that the outer circumferential side of the inner sleeve 81 fits to the inner circumferential side of the outer sleeve 82 as illustrated in FIG. 4, so the outside of the inner sleeve 81 fits to the inside of the outer sleeve 82.

As a result, vibration stress generated by the gaseous fuel 200 when it flows down through the inner sleeve 81 of the double pipe sleeve 80 is lessened. Therefore, it is possible to suppress variations in a change in the flow rate of the gaseous fuel 200 flowing through the inner sleeve 81.

Since the circular spacing 83 is formed between the inner sleeve 81 and the outer sleeve 82, which constitute the double pipe sleeve 80, heat that the inner sleeve 81 receives from the gaseous fuel 200 when it is supplied is not easily transmitted to the outer sleeve 82. Therefore, it is possible to suppress the outer sleeve 82 from being thermally contracted.

Since the circular spacing 83 formed between the inner sleeve 81 and the outer sleeve 82, which constitute the double pipe sleeve 80, suppresses the thermal contraction of the outer sleeve 82, thermal contraction of the upstream side and downstream side of the outer sleeve 82 are also suppressed, the upstream side being welded to a side wall of the end cover 40 with the all-around fillet welded portion 10, and the downstream side being welded to the inner wall surface of the gaseous fuel flow path 30*a* of the pre-mixing combustion burner 30 with the all-around single-bevel butt fillet welded portion 11. Therefore, thermal stress exerted on the all-around fillet welded portion 10 and all-around single-bevel butt fillet welded portion 11, which are formed on the outer sleeve 82 of the double pipe sleeve 80, is also mitigated. As a result, the dual-fuel burning gas turbine combustor becomes superior in safety.

When the gaseous fuel 200 is supplied to the double pipe sleeve 80, the inner sleeve 81 of the double pipe sleeve 80 may be rotated in the circumferential direction due to a fuel eddy caused in the gaseous fuel 200 and the inner sleeve 81 may be thereby worn out. To prevent this wear, the upstream ends of the inner sleeve 81 and outer sleeve 82 are mutually welded through the welded portion 12 so as to be secured as illustrated in FIG. 4, preventing the inner sleeve 81 from being rotated in the circumferential direction due to a fuel eddy caused when the gaseous fuel 200 is supplied and thereby preventing the inner sleeve 81 from being worn out. Accordingly, the operating life of the double pipe sleeve 80 can be prolonged.

Furthermore, a groove 37 is formed on the inner wall surface of the gaseous fuel flow path 30*a*, which is formed in the pre-mixing combustion burner 30 so that the gaseous fuel 200 flows down. Accordingly, when the gaseous fuel 200 at a low temperature is supplied to the double pipe sleeve 80 disposed in the end cover 40 and pre-mixing combustion burner 30, stress generated due to thermal contraction of the outer sleeve 82 that is caused when the all-around single-bevel butt fillet welded portion 11, which mutually bonds the inner wall surface of the gaseous fuel flow path 30*a* of the pre-mixing combustion burner 30 and the downstream end of the double pipe sleeve 80, is formed is reduced by deforming a groove end 37*a* of the groove 37 formed on the inner wall surface of the gaseous fuel flow path 30*a* of the pre-mixing combustion burner 30. To deform the groove end 37*a*, the groove 37 is formed close to the all-around single-bevel butt fillet welded portion 11 at the downstream end of the double pipe sleeve 80.

That is, since the groove end 37*a* of the groove 37 formed on the inner wall surface of the gaseous fuel flow path 30*a* of the pre-mixing combustion burner 30 is deformed due to thermal contraction of the outer sleeve 82 of the double pipe sleeve 80, which is caused by the all-around single-bevel butt fillet welded portion 11 formed at the downstream end of the double pipe sleeve 80, the amount of deformation of the outer sleeve 82 can be reduced.

Since the groove 37 having the groove end 37*a* is formed on the inner wall surface of the gaseous fuel flow path 30*a* of the pre-mixing combustion burner 30 so as to be close to the all-around single-bevel butt fillet welded portion 11 at the downstream end of the double pipe sleeve 80, stress caused by the thermal contraction of the outer sleeve 82 can be reduced by the deformation of the groove end 37*a* of the groove 37 and the operating life of the double pipe sleeve 80 can thereby be prolonged. As a result, a dual-fuel burning gas turbine combustor with high reliability can be achieved.

According to this embodiment, there can be achieved a dual-fuel burning gas turbine combustor that suppresses thermal contraction caused due to a difference in temperature when a gaseous fuel is supplied and reduces stress exerted on a welded portion by which a sleeve is attached, while having high reliability and corresponding both a liquid fuel and a gaseous fuel.

Embodiment 2

A dual-fuel burning gas turbine combustor, in a second embodiment of the present invention, that can use both a liquid fuel and a gaseous fuel will be described below with reference to FIG. 5.

The dual-fuel burning gas turbine combustor 1, in this embodiment illustrated in FIG. 5, that can use both a liquid fuel and a gaseous fuel has the same basic structure as the dual-fuel burning gas turbine combustor 1, in the first embodiment illustrated in FIGS. 1 to 4, that can use both a liquid fuel and a gaseous fuel, so descriptions common to them will omitted and only different structures will be described below.

Figure 5:
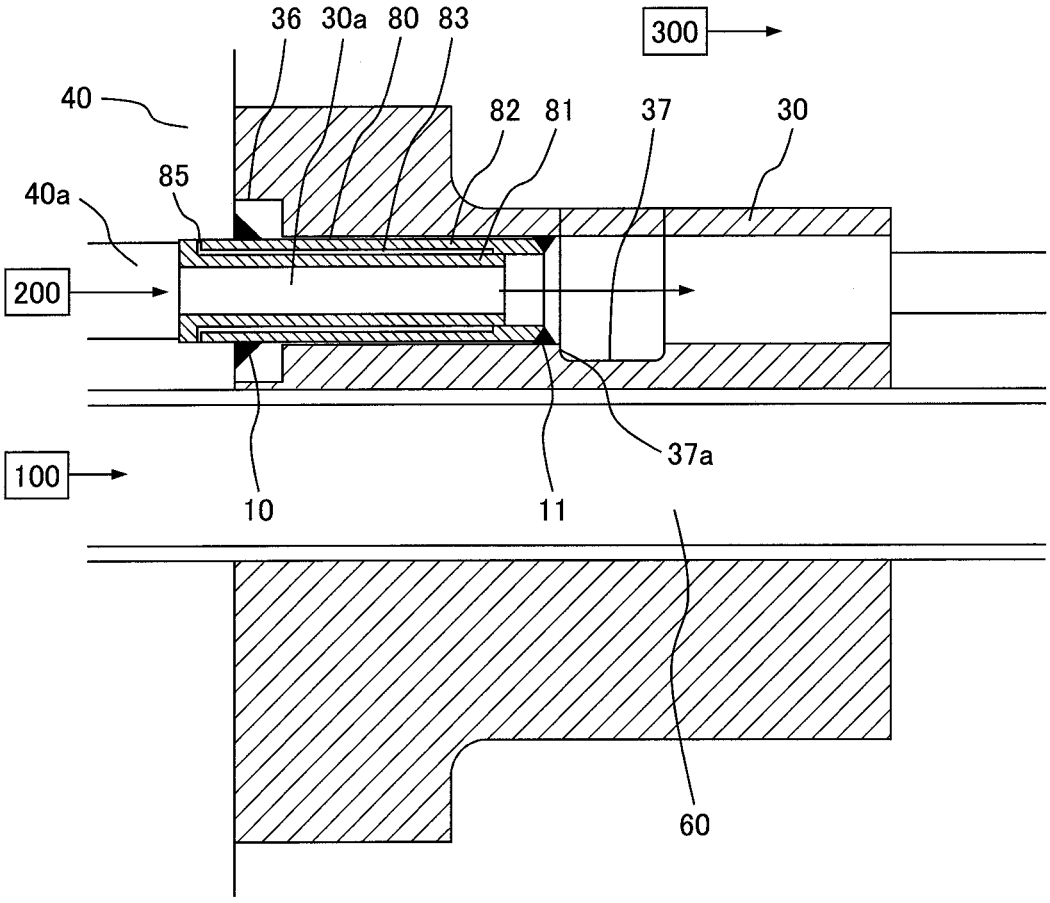
FIG. 5 is a partial cross sectional view of a double pipe sleeve provided in a pre-mixing combustion burner in a dual-fuel burning gas turbine combustor in a second embodiment of the present invention when a gaseous fuel is supplied.

In the dual-fuel burning gas turbine combustor 1 in FIG. 5, the double pipe sleeve 80 disposed in the end cover 40 and the pre-mixing combustion burner 30 is structured so that the upstream ends of the inner sleeve 81 and the outer sleeve 82, which constitute the double pipe sleeve 80, are brought into contact with each other without being welded. The downstream ends of the inner sleeve 81 and the outer sleeve 82, which constitute the double pipe sleeve 80, are structured so that the outer circumferential side of the inner sleeve 81 is fitted to the inner circumferential side of the outer sleeve 82.

That is, in the dual-fuel burning gas turbine combustor 1 in this embodiment, the double pipe sleeve 80 is structured in such a way that the inner sleeve 81 and the outer sleeve 82 are fitted to each other without welding them. Specifically, a spacing 85 is formed at one end of the inner sleeve 81 and the outer sleeve 82, which constitute the double pipe sleeve 80 disposed in the end cover 40 and the pre-mixing combustion burner 30, and the inner sleeve 81 and outer sleeve 82 are brought into contact with each other at the other end.

The inner sleeve 81, which is part of the double pipe sleeve 80 of the dual-fuel burning gas turbine combustor 1 in this embodiment, is fitted to the outer sleeve 82 without being welded to it, so that even when the gaseous fuel 200 at a low temperature is supplied to the inner sleeve 81, the heat transfer coefficient from the inner sleeve 81 to the outer sleeve 82 is further reduced. Therefore, thermal contraction can be further mitigated that is caused in the outer sleeve 82 of the double pipe sleeve 80 when the gaseous fuel 200 at a low temperature flows down through the inner sleeve 81 of the double pipe sleeve 80.

In the double pipe sleeve 80 of the dual-fuel burning gas turbine combustor 1 in this embodiment, as illustrated in FIG. 5, the outer sleeve 82 of the double pipe sleeve 80 has, at its upstream end, a portion that is secured to a side surface of the end cover 40 by being bonded through the all-around fillet welded portion 10 and also has, at its downstream end, a portion that is secured to the inner wall surface of the gaseous fuel flow path 30*a* of the pre-mixing combustion burner 30 by being bonded through the all-around single-bevel butt fillet welded portion 11. Therefore, even when the gaseous fuel 200 at a low temperature is supplied through the inner sleeve 81 of the double pipe sleeve 80, thermal contraction caused in the outer sleeve 82 of the double pipe sleeve 80 can be mitigated and stress exerted on the all-around fillet welded portion 10 and all-around single-bevel butt fillet welded portion 11 of the double pipe sleeve 80 can be reduced, so the operating life of the double pipe sleeve 80 can be prolonged. It is also possible to prevent the gaseous fuel 200 flowing down through the double pipe sleeve 80 from leaking toward the combustion air 300, which is on the outer circumferential side of the pre-mixing combustion burner 30. As a result, a dual-fuel burning gas turbine combustor with high reliability can be achieved.

According to this embodiment, there can be achieved a dual-fuel burning gas turbine combustor that suppresses thermal contraction caused due to a difference in temperature when a gaseous fuel is supplied and reduces stress exerted on a welded portion by which a sleeve is attached, while having high reliability and supporting both a liquid fuel and a gaseous fuel.

The invention claimed is:

1. A dual-fuel burning gas turbine combustor comprising: a liquid fuel and a gaseous fuel, in which a diffusive combustion burner that burns the liquid fuel and the gaseous fuel is placed at the center of the axis of the gas turbine combustor and a plurality of pre-mixing combustion burners that burns the liquid fuel and the gaseous fuel are placed on an outer circumferential side of the diffusive combustion burner, each pre-mixing combustion burner comprising:

a liquid fuel nozzle through which the liquid fuel is supplied;

a plurality of gaseous fuel spray holes through which the gaseous fuel is supplied;

a plurality of air holes through which a combustion air is supplied; and a gaseous fuel flow path through which the gaseous fuel is supplied to the plurality of gaseous fuel spray holes, the fuel spray holes and the air holes are being placed on an outer circumferential side of the liquid fuel nozzle, and a pre-mixing chamber in which the gaseous fuel and the combustion air are mixed together;

an end cover which is provided with the pre-mixing combustion burner at the downstream side thereof, and a flow path through which the gaseous fuel supplied from the gaseous fuel flow path configured to provide gaseous fuel flow, is formed within the end cover; and a double pipe sleeve which is attached to at a connected portion between the flow path disposed in the end cover and the gaseous fuel flow path disposed in the pre-mixing combustion burner;

wherein, the double pipe sleeve which is provided with a cylindrical inner sleeve through which the gaseous fuel flows down from the flow path disposed in the end cover to a gaseous fuel flow path disposed in the pre-mixing combustion burner, an outer sleeve which is disposed to be concentric with the cylindrical inner sleeve positioned on an outer circumferential side of the cylindrical inner sleeve;

the cylindrical inner sleeve and the outer sleeve of the double pipe sleeve both extend and overlap each other approximately between an upstream portion of the gaseous fuel flow path and a downstream portion of the gaseous fuel flow path;

the outer sleeve of the double pipe sleeve has a first end that is attached to an inner wall surface of the pre-mixing combustion burner by a first welded portion approximately at the downstream portion of the gaseous fuel flow path;

the cylindrical inner sleeve of the double pipe sleeve has a first end that is attached to a second end of the outer sleeve of the double pipe sleeve by a second welded portion at the upstream portion of the gaseous fuel flow path; and a circular spacing is formed between and enclosed by the cylindrical inner sleeve and the outer sleeve of the double pipe sleeve.

2. The dual-fuel burning gas turbine combustor according to claim 1, wherein: ends of the cylindrical inner sleeve and the outer sleeve of the double pipe sleeve are mutually welded; and an end of the outer sleeve is welded to the end cover, and another end of the outer sleeve is welded to an inner wall surface of the gaseous fuel flow path disposed in the pre-mixing burner.

3. The dual-fuel burning gas turbine combustor according to claim 1, wherein: ends of the cylindrical inner sleeve and the outer sleeve of the double pipe sleeve are joined so that the cylindrical inner sleeve is fitted to an inside of the outer sleeve; and an end of the outer sleeve is welded to the end cover, and another end of the outer sleeve is welded to an inner wall surface of the gaseous fuel flow path disposed in the pre-mixing burner.

4. The dual-fuel burning gas turbine combustor according to claim 2, wherein: a groove is formed on the inner wall surface of the gaseous fuel flow path formed in the pre-mixing burner so as to be close to a welded portion by which the another end of the outer sleeve of the double pipe sleeve is welded to the inner wall surface of the gaseous fuel flow path.

5. The dual-fuel burning gas turbine combustor according to claim 3, wherein: a groove is formed on the inner wall surface of the gaseous fuel flow path formed in the pre-mixing burner so as to be close to a welded portion by which the another end of the outer sleeve of the double pipe sleeve is welded to the inner wall surface of the gaseous fuel flow path.

* * * * *